United States Patent [19]

Hyde

[11] Patent Number: 4,601,609

[45] Date of Patent: Jul. 22, 1986

[54] BUOYANCY DEVICE

[76] Inventor: Robert W. Hyde, 9340 W. Putter Ct., Crystal River, Fla. 32629

[21] Appl. No.: 728,694

[22] Filed: Apr. 29, 1985

[51] Int. Cl.[4] ..... B63C 11/02

[52] U.S. Cl. ..... 405/186; 441/96

[58] Field of Search ..... 405/185, 186, 187, 193; 441/92, 96; 137/102, 505.11

[56] References Cited

U.S. PATENT DOCUMENTS

| | | | |
|---|---|---|---|
| 3,820,348 | 6/1974 | Fast | 405/186 |
| 4,101,998 | 7/1978 | Buckle | 405/186 |
| 4,324,507 | 4/1982 | Harrah | 405/186 |
| 4,379,656 | 4/1983 | Darling | 405/186 |

*Primary Examiner*—David H. Corbin

[57] ABSTRACT

A hydrostatically controlled buoyancy compensator to maintain a predetermined buoyancy for an aquatic diver and buoyancy device at any depth comprising a control valve and pressure equalization chamber operatively coupled together by a control valve actuator; the control valve comprises a control valve housing having a multiple position valve body movably disposed therein, the control valve housing includes a regulator passage, buoyancy device passage and vent passage formed therein and the multiple position valve body includes a regulator channel and vent channel formed therein to selectively feed pressurized air from an external source to the buoyancy device and from the buoyancy device to the water; the pressure equalization chamber comprises a hollow constant volume pressure equalization housing having a pressure equalization port formed therein in fluid communication with the buoyancy device; the control valve actuator comprises a hollow control valve actuator housing having a multiple position valve positioner movably disposed therein and a valve actuator coupler operatively coupled between the multiple position valve positioner and multiple position valve body, the hollow control valve actuator housing includes a pressure equalization chamber passage and an external passage formed therein in fluid communication with the pressure equalization chamber and water respectively such that the multiple position valve positioner senses the pressure differential between the water and pressure equalization chamber through the external passage and pressure equalization chamber passage respectively.

4 Claims, 5 Drawing Figures

FIG. 1
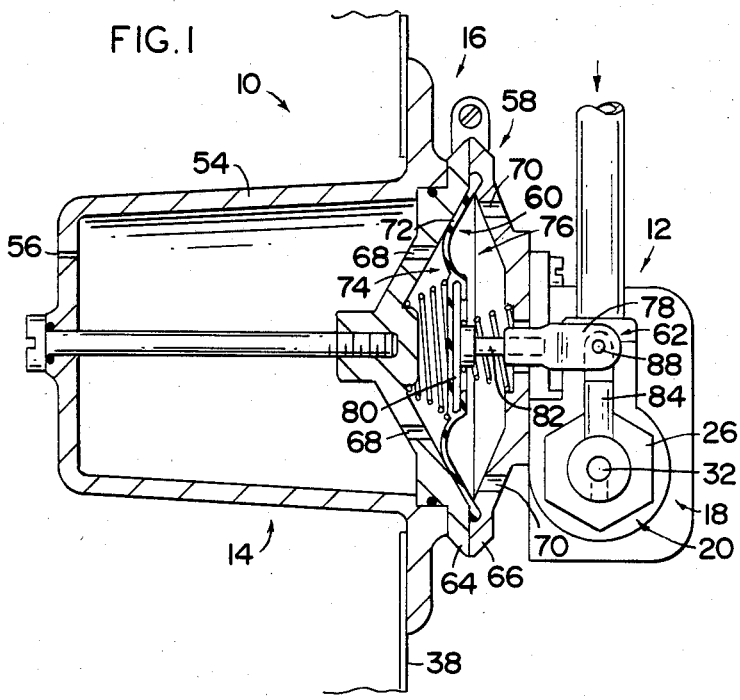
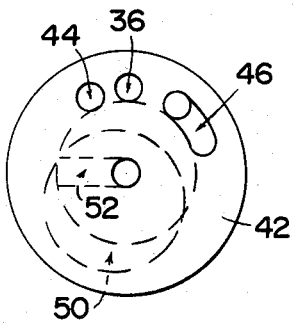
FIG. 3
FIG. 4
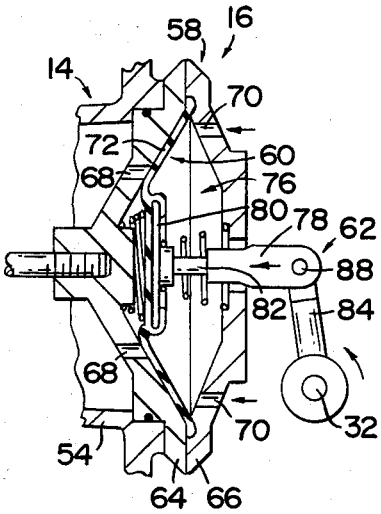
FIG. 2
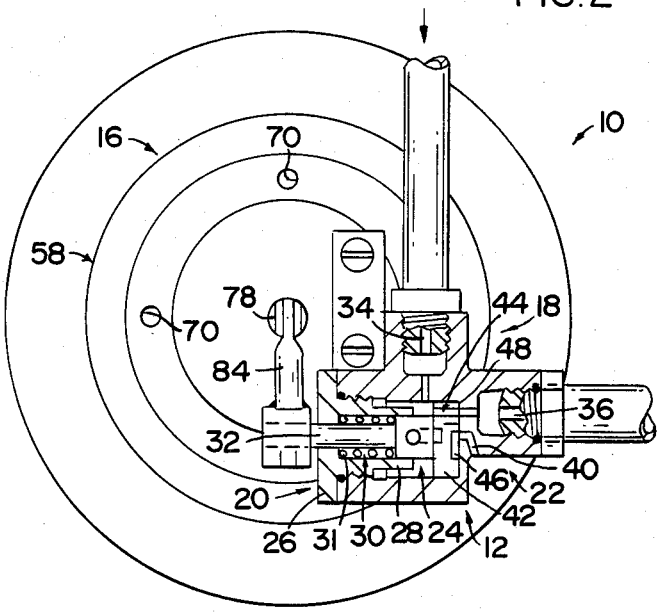
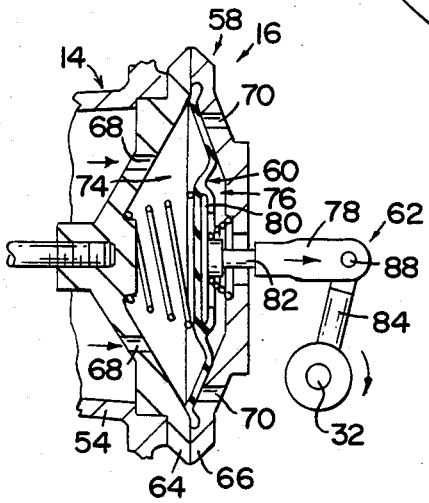
FIG. 5

BUOYANCY DEVICE

BACKGROUND OF THE INVENTION

1. Field of the Invention

A hydrostatically controlled buoyancy compensator to maintain a predetermined buoyancy for a diver and buoyancy device at any depth.

2. Description of the Prior Art

Various devices have been constructed to provide neutral buoyancy for divers. It should be noted that a change of depth of one foot in water changes the pressure approximately 0.441 lbs. It should also be understood that depth changes of ten or more feet reduce the air floatation bubble in a buoyancy device such that considerably less water is displaced thus causing the diver sink. The rate of sink increases as the depth increases if air is not added to the buoyancy device. Conversely, when rising from a dive, the air bubble becomes progressively larger displacing much more water thereby increasing the buoyancy causing a faster ascent than desired if some of the air is not released by the diver.

Briefly, buoyancy devices now available require the diver to manually operate a remote valve to feed air into the buoyancy device as the diver decends and release air from the buoyancy device as the diver ascends.

SUMMARY OF THE INVENTION

The present invention relates to a hydrostatically controlled buoyancy compensator to maintain a predetermined buoyancy for a diver and buoyancy device at any depth.

The hydrostatically controlled buoyancy compensator comprises a control valve and pressure equalization chamber operatively coupled together by a control valve actuator.

The control valve comprises a control valve housing including a regulator passage coupled to a diving regulator or pressurized gas source, buoyancy device passage coupled to a buoyancy device, and vent passage exposed to the water to selectively provide fluid communication between the diving regulator or pressurized gas source and buoyancy device and between the buoyancy device and water as described more fully herein.

A control valve body including a regulator channel and vent channel or arcuate recess formed therein is rotatably disposed within the control valve housing.

The pressure equalization chamber comprises a hollow constant volume pressure equalization housing having a pressure equalization port formed therein in fluid communication with the buoyancy device.

The control valve actuator comprises a control valve actuator housing having a multiple position valve positioner movably disposed therein. A valve actuator coupler operatively couples the multiple position valve positioner and the multiple position control valve body.

The control valve actuator housing includes at least one pressure equalization chamber passage formed therein to expose one side of the multiple position valve positioner to the pressure within the pressure equalization chamber and at least one external passage formed therein to expose the opposite side of the multiple position valve positioner to the water pressure.

The multiple position valve positioner comprises a deflectable diaphram mounted within the control valve actuator housing to cooperatively form an air reservoir and water reservoir to permit deflection of the multiple position valve positioner in response to pressure differential pressures between pressure equalization chamber and water as described more fully hereinafter.

The valve actuator coupler comprises a first valve actuator coupler member coupled to the deflectable diaphram and a second valve actuator coupler member coupled to the control valve body. The first and second valve actuator coupler members are pivotally coupled together such that movement of the deflectable diaphram rotates the control valve body.

In use, the regulator passage is coupled to a diving regulator or pressurized gas source while the buoyancy device passage is coupled to the buoyancy device.

When the water pressure and the pressure within the pressure equalization chamber are substantially equal, the deflectable diaphram and control valve body are in the neutral position. As a result, neither the regulator channel or vent channel is aligned with the buoyancy device passage isolating the interior of the buoyancy device. Air is neither fed to nor expelled from the buoyancy device.

As the diver descends in the water, the increased water pressure is applied against or sensed by the deflectable diaphram through the external passage. Since the internal pressure within the pressure equalization chamber is less than the water pressure, the deflectable diaphram moves inwardly rotating the control valve body through the valve actuator coupler or linkage aligning the regulator channel with the buoyancy device passage causing pressurized air to be fed from the valve body chamber to the buoyancy device or vest to maintain the buoyancy device at a substantially constant volume.

Correspondingly, as the diver ascends, the greater pressure within the pressure equalization chamber acts against the surface of the deflectable diaphram forcing the deflectable diaphram outwardly thereby rotating the control valve body in the opposite direction to align the buoyancy device passage, vent channel or arcuate recess and vent passage expelling air from the buoyancy device to maintain the buoyancy device at a substantially constant volume.

When the diver remains at any depth, air is fed to or from the buoyancy device through the pressure equalization port of the pressure equalization housing until the pressure within the air reservoir and water reservoir are substantially equal returning the deflectable diaphram to the neutral position.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which:

FIG. 1 is a partial cross-sectional side view of the hydrostatically controlled buoyancy compensator.

FIG. 2 is an end view of the hydrostatically controlled buoyancy compensator in the pressurization position.

FIG. 3 is a diagrammatic end view of the control valve body in the neutral position.

FIG. 4 is a partial detailed side view of the control valve actuator in the pressurization position.

FIG. 5 is a partial detailed side view of the control valve actuator in the depressurization position.

Similar reference characters refer to similar parts throughout the several views of the drawings.

DETAILED DESCRIPTION OF THE PREFERRED EMBODIMENT

As shown in FIGS. 1 and 2, the present invention relates to a hydrostatically controlled buoyancy compensator generally indicated as 10 to maintain a predetermined buoyancy for a diver and buoyancy device at any depth. The hydrostatically controlled buoyancy compensator 10 comprises a control valve and pressure equalization chamber generally indicated as 12 and 14 respectively operatively coupled together by a control valve actuator generally indicated as 16.

As best shown in FIG. 2, the control valve 12 comprises a control valve housing generally indicated as 18 including a first and second control valve housing member indicated as 20 and 22 respectively cooperatively forming a valve body chamber 24 therebetween. The first control valve housing member 20 comprises a base element 26 having a centrally disposed protrusion 28 extending inwardly therefrom. A bias recess 30 to receive bias 31 is formed on the centrally disposed protrusion in axial alignment with a centrally disposed shaft receiving channel 32 formed in the base element 26. The second control valve housing member 22 includes a regulator passage 34 coupled to a diving regulator or pressurized gas source (not shown), buoyancy device passage 36 coupled to a buoyancy device 38, and vent passage 40 exposed to the water to selectively provide fluid communication between the diving regulator or pressurized gas source (not shown) and buoyancy device 38 and between the buoyancy device 38 and water as described more fully herein.

As best shown in FIGS. 2 and 3, a control valve body 42 is movably disposed within the valve body chamber 24. As described more fully hereinafter, the control valve body 42 is rotatably between a neutral, pressurizing and depressurizing position by the control valve actuator 16. The control valve body 42 includes a regulator channel 44 axially formed therein and vent channel or arcuate recess 46 formed in the front surface 48 thereof. An annular pressure balance cavity and radial feed passage indicated as 50 and 52 respectively are also formed in the front surface 48.

As best shown in FIG. 1, the pressure equalization chamber 14 comprises a hollow constant volume pressure equalization housing 54 having a pressure equalization port 56 formed therein in fluid communication with the buoyancy device 38.

As best shown in FIGS. 1, 4 and 5 the control valve actuator 16 comprises a hollow control valve actuator housing generally indicated as 58 having a multiple position valve positioner generally indicated as 60 movably disposed therein. Together the hollow control valve actuator housing 58 and multiple position valve positioner 60 form a pressure differential sensing means to continuously sense the relative pressures between the water or the buoyancy device 38 and the pressure equalization chamber 14. A valve actuator coupler generally indicated as 62 operatively couples the multiple position valve positioner 60 and multiple position valve body 42.

The hollow control valve actuator housing comprises a first and second control valve actuator housing member 64 and 66 respectively. The first control valve actuator housing member 64 includes at least one pressure equalization chamber passage 68 to expose one side of the multiple position valve positioner 60 to the pressure within the pressure equalization chamber while the second control valve actuator housing member 66 includes at least one external passage 70 to expose the opposite side of the multiple position valve positioner valve 60 to the water pressure.

The multiple position valve positioner 60 comprises a deflectable diaphram 72 mounted between the first and second control valve actuator housing member 64 and 66 to cooperatively form an air reservoir and water reservoir 74 and 76 respectively to permit deflection of the multiple position valve positioner 60 in response to differential pressure as described more fully hereinafter.

The valve actuator coupler 62 comprises a first valve actuator coupler member 78 coupled to the deflectable diaphram 72 by a diaphram plate 80 by an attachment pin 82 and a second valve actuator coupler member 84 coupled to the control valve body 42 by a shaft 86. The first and second valve actuator coupler members 78 and 84 are pivotally coupled together by a connector 88 such that movement of the deflectable diaphram 72 rotates the central valve body 42.

In use, the air passage 34 is coupled to a diving regulator or pressurized gas source (not shown) while the buoyancy device passage 36 is coupled to the bouyancy device 38.

When the water pressure and the pressure within the pressure equalization chamber 14 are substantially equal, the deflectable diaphram 72 and control valve body 42 are in the neutral position as shown in FIGS. 1 and 3. As a result, neither the regulator channel 44 nor vent channel 46 is aligned with the buoyancy device passage 36 isolating the interior of the buoyancy device 38. As a result, air is neither fed to nor expelled from the buoyancy device 38.

Since the buoyancy device or vest 38 is compressible and expandable, the buoyancy device or vest 38 will compress or expand to maintain an internal pressure substantially equal to the external water pressure as the diver descends or ascends respectively to maintain a substantially constant predetermined buoyancy. Air is fed to or from the buoyancy device 38 as described hereinafter.

Specifically, as shown in FIGS. 2 and 4 as the diver descends in the water, the increased water pressure is applied against or sensed by the deflectable diaphram 72 through the external passage 70. Since the internal pressure within the pressure equalization chamber 14 is less than the water pressure, the deflectable diaphram 72 moves inwardly rotating the control valve body 42 through the valve actuator coupler or linkage 62 aligning the regulator channel 44 with the buoyancy device passage 36 causing pressurized air to be fed from the valve body chamber 24 to the buoyancy vest 38 to maintain the buoyancy device 38 at a substantially constant volume.

When the diver remains at any depth, air is fed from the buoyancy device 38 through the pressure equalization port 56 into the hollow constant volume pressure equalization housing 56 The air then enters the air reservoir 74 until pressure within the air reservoir and water reservoir 74 and 76 are substantially equal returning the deflectable diaphram 72 to the neutral position.

Correspondingly, as shown in FIG. 5, as the diver ascends the greater pressure within the pressure equalization chamber 14 acts against the surface of the deflectable diaphram 72 forcing the deflectable diaphram 72 outwardly thereby rotating the control valve body 42 in the opposite direction to align the buoyancy device passage 36, vent channel or arcuate recess 46 and vent passage 40 expelling air from the buoyancy device 38 to maintain the buoyancy device 38 at a substantially constant volume.

When the diver remains at any depth, air is fed to the buoyancy device 38 through the pressure equalization port 56 from the hollow constant volume pressure equalization housing 56. The air continues to be expelled from the buoyancy device 38 through the vent passage 40 until pressure within the air reservoir and water reservoir 74 and 76 are substantially equal returning the deflectable diaphram 72 to the neutral position.

Pressurized air is fed from the valve body chamber 24 through the radial feed passage 52 to the annular pressure balance cavity 50 to facilitate rotation of the control valve body 42 by balancing the pressure on opposite sides of the control valve body 42.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A hydrostatically controlled buoyancy compensator to maintain a predetermined buoyancy for an aquatic diver using a buoyancy device comprising a control valve and pressure equalization chamber operatively coupled together by a control valve actuator; said control valve comprises a control valve housing having a multiple position valve body movably disposed therein; said control valve housing includes a regulator passage, buoyancy device passage and vent passage formed therein and said multiple position valve body includes a regulator channel and vent channel formed therein to selectively feed pressurized air from an external source to the buoyancy device and from the buoyancy device to the water; said pressure equalization chamber comprises a hollow constant volume pressure equalization housing; said control valve actuator comprises a hollow control valve actuator housing having a multiple position valve positioner movably disposed therein and a valve actuator coupler operatively coupled between said multiple position valve positioner and said multiple position valve body, said hollow control valve actuator housing includes a pressure equalization chamber passage and an external passage formed therein in fluid communication with said pressure equalization chamber and water respectively such that said multiple position valve positioner continuously senses the pressure differential between the water and said pressure equalization chamber through said external passage and said pressure equalization chamber passage respectively whereby as the diver descends the increased water pressure causes said multiple position valve positioner to move to a pressuration position to operatively align said regulator channel with said buoyancy device passage to feed pressurized air from the diver's regulator to the buoyancy device through said regulator passage and as the diver ascends the decreased water pressure causes said multiple position positioner to move to a depressuration position to operatively align said vent port with said vent passage and said buoyancy device passage to expel air from the buoyancy device to maintain the volumetric displacement of the buoyancy substantially constant.

2. The hydrostatically controlled buoyancy compensator of claim 1 wherein said pressure equalization chamber further includes a pressure equalization port formed therein in fluid communication with the buoyancy device, such that when the diver remains at any depth, air is fed to or from the buoyancy device through said pressure equalization chamber through said pressure equalization port to equalize the pressure within said pressure eqwualization chamber and the water pressure to return said multiple position valve body to isolate the buoyance device.

3. The hydrostatically controlled buoyancy compensator of claim 1 wherein said vent port comprises an arcuate recess formed on the front surface of said multiple position valve body.

4. The hydrostatically controlled buoyancy compensator of claim 1 further including a pressure balance cavity formed in the front surface of said multiple position valve body and a radial feed passage extending from the periphery of said multiple position valve body to feed air to said pressure balance cavity.

* * * * *